US009303655B2

(12) United States Patent
Griffin

(10) Patent No.: US 9,303,655 B2
(45) Date of Patent: Apr. 5, 2016

(54) SEAL FOR A HIGH-PRESSURE TURBOMACHINE

(71) Applicant: Daniel J. Griffin, Enfield, CT (US)

(72) Inventor: Daniel J. Griffin, Enfield, CT (US)

(73) Assignee: Dresser-Rand Company, Olean, NY (US)

( * ) Notice: Subject to any disclaimer, the term of this patent is extended or adjusted under 35 U.S.C. 154(b) by 1 day.

(21) Appl. No.: 14/317,283

(22) Filed: Jun. 27, 2014

(65) Prior Publication Data

US 2015/0016988 A1 Jan. 15, 2015

Related U.S. Application Data

(60) Provisional application No. 61/843,629, filed on Jul. 8, 2013.

(51) Int. Cl.

| | |
|---|---|
| ***F04D 29/16*** | (2006.01) |
| ***F04D 29/42*** | (2006.01) |
| ***F04D 17/12*** | (2006.01) |

(52) U.S. Cl.

CPC ..... *F04D 29/162* (2013.01); *F04D 17/122* (2013.01); *F04D 29/4206* (2013.01)

(58) Field of Classification Search

CPC ..... F16J 15/54; F16J 15/16; F16J 15/442; F16J 15/44; F04D 17/122; F04D 29/083; F04D 29/162; F04D 29/4206

USPC ..... 415/110, 175, 214.1; 277/641, 642, 277/543, 544

See application file for complete search history.

(56) References Cited

U.S. PATENT DOCUMENTS

| | | | | | |
|---|---|---|---|---|---|
| 2,717,023 | A * | 9/1955 | Hetherington | B29C 63/22 | 156/293 |
| 3,690,682 | A | 9/1972 | Ferrill | | |
| 3,743,303 | A * | 7/1973 | Pope | F01D 11/00 | 277/422 |
| 4,961,260 | A | 10/1990 | Ferri et al. | | |
| 5,087,172 | A | 2/1992 | Ferri et al. | | |
| 5,169,159 | A * | 12/1992 | Pope | F16J 15/441 | 277/422 |
| 5,322,298 | A | 6/1994 | Maier | | |

(Continued)

OTHER PUBLICATIONS

PCT/US2014/045173—Notification of Transmittal of the International Search Report and the Written Opinion of the International Searching Authority, or the Declaration, International Search Report, Written Opinion of the International Searching Authority, dated Oct. 30, 2014, 11 pages.

*Primary Examiner* — Igor Kershteyn
*Assistant Examiner* — Jesse Prager
(74) *Attorney, Agent, or Firm* — Edmonds & Nolte, PC

(57) ABSTRACT

An annular seal is provided for use in a turbomachine. The annular seal may form a generally rectangular cross-section and may include an outer radial surface forming an outer sealing surface and defining at least one annular groove and a plurality of slots spaced circumferentially about the outer radial surface. Each slot may have an end terminating in the at least one annular groove. The annular seal may also include a first axial sidewall forming a sidewall sealing surface and a recessed portion and a second axial sidewall opposing the first axial sidewall. At least one annular groove and the plurality of slots may be configured to maintain a low pressure environment across at least a portion of the outer radial surface. The second axial sidewall, the recessed portion, and the inner radial surface may be configured to maintain a high pressure environment there across during operation of the turbomachine.

9 Claims, 3 Drawing Sheets

(56) References Cited

U.S. PATENT DOCUMENTS

| | | | |
|---|---|---|---|
| 6,030,174 | A | 2/2000 | Maier et al. |
| 6,860,719 | B2 | 3/2005 | Burdgick |
| 6,997,677 | B2 | 2/2006 | Munshi et al. |
| 2008/0017814 | A1* | 1/2008 | Berckenhoff ..... E21B 33/061 251/1.3 |
| 2009/0146379 | A1 | 6/2009 | Foster et al. |
| 2012/0003088 | A1 | 1/2012 | Haq |
| 2013/0149101 | A1 | 6/2013 | Clute et al. |

* cited by examiner

SEAL FOR A HIGH-PRESSURE TURBOMACHINE

CROSS-REFERENCE TO RELATED APPLICATIONS

This application claims priority to U.S. Provisional Patent Application Ser. No. 61/843,629, filed on Jul. 8, 2013. This priority application is hereby incorporated by reference in its entirety into the present application to the extent consistent with the present application.

BACKGROUND

Turbomachines, e.g., compressors, typically include one or more seals arranged therein to substantially segregate a high pressure fluid from a low pressure fluid and/or the atmosphere. For example, a high pressure centrifugal compressor may include a compressor bundle installed in the casing bore of a compressor casing and/or housing with an inlet side (low-pressure) and a working chamber (high-pressure). One or more seals, e.g., O-rings, may be mounted about the compressor bundle and configured to seat against the inner surface of the compressor casing upon insertion of the compressor bundle in the casing bore.

In a compressor with operating pressures greater than 10,000 psi, typical compressor bundles inserted therein may utilize O-rings as well as back-up ring seals. At high pressures in compressors, however, it has been discovered that the O-rings utilized therein show increased failure rates for at least two reasons. First, under high pressure, the casing itself expands or grows radially, increasing the gap between the compressor bundle and the inner surface of the casing. The increased size of the gap may promote extrusion of the O-ring into the gap, thereby increasing failure rates. Second, O-rings may absorb fluids, e.g., carbon dioxide, at high pressure and then blister and/or explode when the high pressure is reduced and/or released.

What is needed, then, is an alternative to traditional O-rings providing sealing performance at high pressure, e.g., greater than 10,000 psi.

SUMMARY

Embodiments of the disclosure may provide an annular seal for use in a turbomachine. The annular seal may include an inner radial surface defining an inner diameter of the annular seal and an outer radial surface opposing the inner radial surface and defining an outer diameter of the annular seal. The outer radial surface may form an outer sealing surface, and the outer radial surface may further define at least one annular groove and a plurality of slots spaced circumferentially about the outer radial surface. Each slot may have an end terminating in the at least one annular groove. The annular seal may also include a first axial sidewall forming a sidewall sealing surface and a recessed portion, and the annular seal may further include a second axial sidewall opposing the first axial sidewall. The annular seal may form a generally rectangular cross-section. At least one annular groove and the plurality of slots may be configured to maintain a low pressure environment across at least a portion of the outer radial surface. The second axial sidewall, the recessed portion, and the inner radial surface may be configured to maintain a high pressure environment there across during operation of the turbomachine.

Embodiments of the disclosure may further provide a compressor. The compressor may include a housing, a shaft rotatably mounted with respect to the housing, and a compressor bundle arranged around the shaft and disposed at least partially within the housing. The compressor may also include an annular seal mounted about a portion of the compressor bundle, such that the annular seal is disposed between the housing and the compressor bundle. The annular seal may include an inner radial surface defining an inner diameter of the annular seal and an outer radial surface opposing the inner radial surface and defining an outer diameter of the annular seal. The outer radial surface may form an outer sealing surface, and the outer radial surface may further define at least one annular groove and a plurality of slots spaced circumferentially about the outer radial surface. Each slot may have an end terminating in the at least one annular groove. The annular seal may also include a first axial sidewall forming a sidewall sealing surface and a recessed portion, and the annular seal may further include a second axial sidewall opposing the first axial sidewall. The annular seal may form a generally rectangular cross-section. At least one annular groove and the plurality of slots may be configured to maintain a low pressure environment across at least a portion of the outer radial surface disposed adjacent an inner surface of the housing. The second axial sidewall, the recessed portion, and the inner radial surface may be configured to maintain a high pressure environment there across during operation of the compressor.

Embodiments of the disclosure may further provide a method for sealing a compressor. The method includes arranging an annular seal about a portion of a compressor bundle. The annular seal may include an inner radial surface defining an inner diameter of the annular seal and an outer radial surface opposing the inner radial surface and defining an outer diameter of the annular seal. The outer radial surface may form an outer sealing surface, and the outer radial surface may further define at least one annular groove and a plurality of slots spaced circumferentially about the outer radial surface. Each slot may have an end terminating in the at least one annular groove. The annular seal may also include a first axial sidewall forming a sidewall sealing surface and a recessed portion, and the annular seal may further include a second axial sidewall opposing the first axial sidewall. The annular seal may form a generally rectangular cross-section. At least one annular groove and the plurality of slots may be configured to maintain a low pressure environment across at least a portion of the outer radial surface. The second axial sidewall, the recessed portion, and the inner radial surface may be configured to maintain a high pressure environment there across during operation of the compressor. The method may also include installing the compressor bundle within a housing of the compressor so that the outer radial surface of the annular seal is adjacent an inner surface of the housing and forms a sealing relationship therewith.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
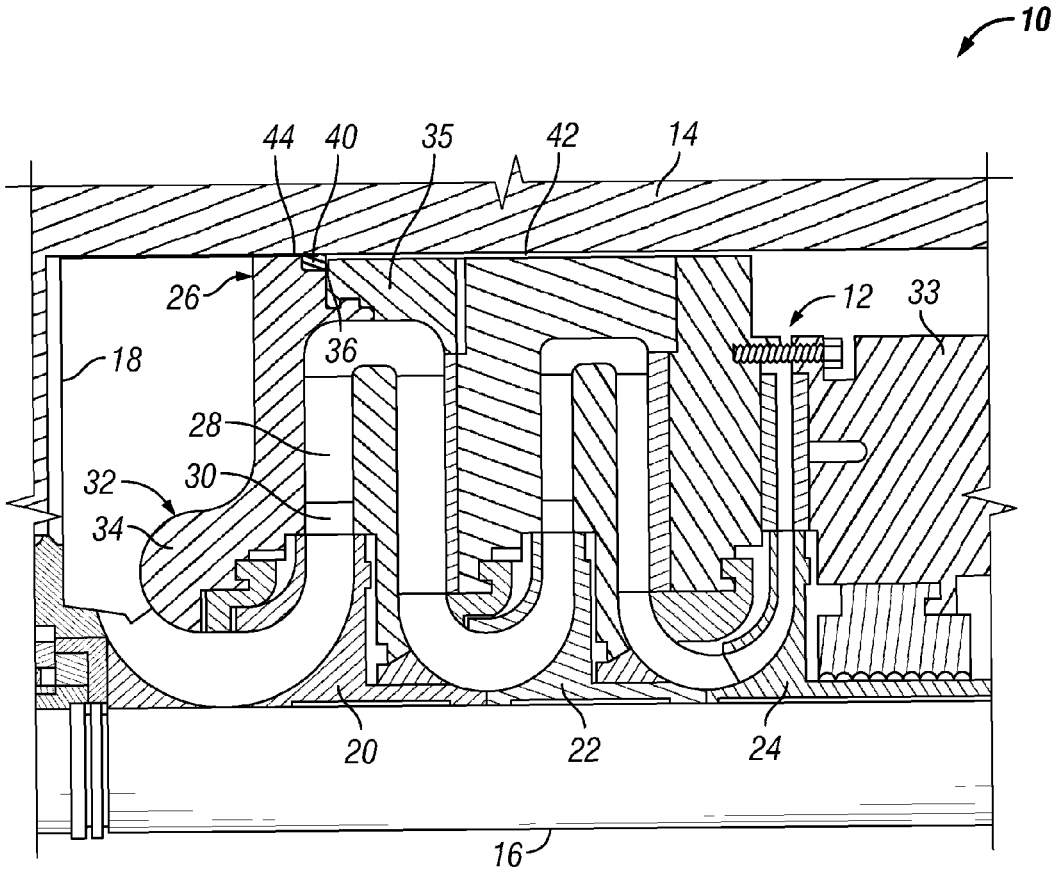
FIG. 1A illustrates a cross-sectional view of a portion of an exemplary compressor having a compressor housing, the compressor including an exemplary annular seal mounted about a compressor bundle installed in the compressor housing, according to one or more embodiments of the present disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1A illustrates an exemplary portion of a compressor 10 in which the teachings of the current disclosure may be practiced. It is to be understood that the type of compressor shown is not in any manner restrictive of the applications of the disclosure. For example, the teachings of the present disclosure may be applied to alternative types of compressors and/or other turbomachines.

The illustration of FIG. 1A includes components of a compressor bundle 12 which may be used in conjunction with a compressor housing 14 of the compressor 10 for pressurizing a working fluid, generally a gas, at high volumes and high efficiency. During assembly, the compressor bundle 12 may be arranged around a central compressor shaft 16, together with appropriate bearings and seals. The combined compressor bundle assembly may be then disposed within the compressor housing 14 and fixed therein.

The central compressor shaft 16 may include a plurality of graduations and/or shoulders along the length thereof to accommodate various gear drives, seals, bearings, multiple impellers, and/or any associated apparatus for compressing the working fluid. The "intake stage" of the compressor bundle 12 appears to the left of FIG. 1A and is the end of the compressor bundle 12 first inserted into the compressor housing 14 during assembly thereof. An appropriate drive gear assembly may be bolted and/or otherwise connected to the intake end of the compressor 10 for driving the central compressor shaft 16. In FIG. 1A, the compressor bundle 12 is shown as a sectional view of an upper portion of the compressor bundle 12 and persons having ordinary skill in the art will recognize that the components of the compressor bundle 12 may be symmetrically oriented around the central compressor shaft 16.

A stationary portion of the compressor bundle 12 may include a pair of diametrically opposed stationary vanes 18 (one shown in FIG. 1A) oriented in an arbitrary direction, but shown vertically in the illustration of FIG. 1A. Numerous other vanes may be employed, depending on the requirements of the compressor 10. One or more compressor impellers (illustrated as three impellers 20, 22, 24 in FIG. 1A) may be fixed to the central compressor shaft 16 and rotate therewith to provide a radial compression of the working fluid.

In the example shown, the working fluid is initially funneled to an intake impeller 20, via the pair of stationary vanes 18. The impellers 20, 22, 24 may be disposed within respective diffuser passages 28 formed within a compressor bundle casing 26. A plurality of stator vanes 30 may be formed within the various diffuser passages 28 and arranged annularly around the central compressor shaft 16. The plurality of stator vanes 30 may transform a velocity pressure of the working fluid imparted by the impellers 20, 22, 24 into a static pressure which may be delivered from the respective diffuser passage 28 to either a subsequent impeller stage or to an output of the compressor 10.

The compressor bundle casing 26 may include several modular parts, including an intake part 32 and a back or discharge part 33, which may be fastened together directly or via intervening modular parts and may be sealed by various sealing components. In an exemplary embodiment, the intake part 32 may be formed from a first casing part 34 and a second casing part 35. The intake part 32 and the discharge part 33 may be fixed with respect to the compressor housing 14 and do not rotate along with the central compressor shaft 16. The compressor bundle casing 26 may include any number of modular parts allowing for ease of assembly, modification, and/or other purposes.

In an exemplary embodiment, the compressor bundle casing 26 may define at least one casing groove 36 around the outer surface of the compressor bundle casing 26. As shown in FIG. 1A, and more clearly in FIG. 1B, the casing groove 36 may be configured to seat therein an annular seal 40. The annular seal 40 may be configured to provide a sealing relationship between the compressor bundle 12 and the compressor housing 14.

Figure 1B:
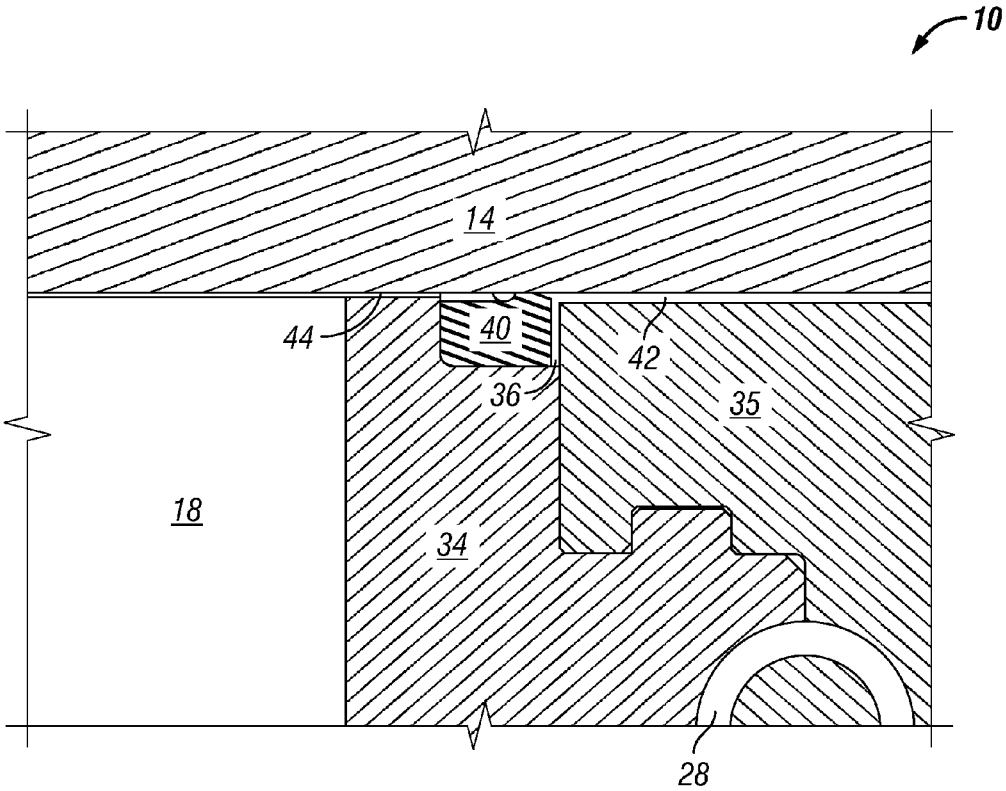
FIG. 1B illustrates an enlarged cross-sectional view of a portion of the compressor bundle installed in the compressor housing of the compressor of FIG. 1A, the annular seal of FIG. 1A mounted about the compressor bundle, according to one or more embodiments of the present disclosure.

FIG. 1B illustrates an enlarged cross-sectional view of a portion of the compressor bundle 12 installed in the compressor housing 14 of the compressor 10 of FIG. 1A, the annular seal 40 of FIG. 1A mounted about a portion of the compressor bundle 12, according to one or more embodiments of the present disclosure. In an exemplary embodiment, the annular seal 40 may form a generally rectangular cross-section and may be mounted about at least a portion of the compressor bundle casing 26 adjacent an inner surface of the compressor housing 14. In some embodiments, the annular seal 40 may fit loosely around the portion of the compressor bundle casing 26, forming a sealing relationship with the compressor bundle casing 26 and/or the compressor housing 14 only when subjected to pressure from the one or more working chambers.

In the example shown, the compressor bundle casing 26 may include the first casing part 34 and the second casing part 35. When first and second casing parts 34, 35 are assembled, they may define the casing groove 36 therebetween for the annular seal 40 to be seated therein. In such embodiments, the annular seal 40 may provide a sealing relationship with various surfaces, including the inner surface of the compressor housing 14 and the sidewalls of the first and second casing parts 34, 35. The assembly of the first and second casing parts 34, 35 may, in part, define one or more of the diffuser passages 28.

The difference in pressure between the working fluid entering the compressor bundle 12 at the stationary vanes 18 (low-pressure) and the working fluid exiting the respective diffuser passageways 28 may create a pressure differential across the annular seal 40. As shown in FIGS. 1A and 1B, a working side gap 42 may allow the high-pressure working fluid to fluidly communication with the annular seal 40 providing a high-pressure environment on portions of the annular seal 40. At the same time, an inlet side gap 44 may allow the low-pressure working fluid to fluidly communication with the annular seal 40 providing a low-pressure environment on other portions of the annular seal 40.

During operation of the compressor, the compressor housing 14 may expand radially because of high working pressures generated by the one or more impellers 20, 22, 24 and respective diffuser passageways 28 (e.g., in excess of 10,000 psi). If the compressor housing 14 expands radially but the compressor bundle casing 26 does not expand at the same rate, both the working side gap 42 and/or the inlet side gap 44 may expand. If the inlet side gap 44 grows, the annular seal 40 may be subjected to increased risk of extrusion through the inlet side gap 44. If the annular seal 40 has extruded into the inlet side gap 44 during operation, the compressor housing 14 may damage the annular seal 40 when it contracts radially to its nominal dimensions.

Figure 2:
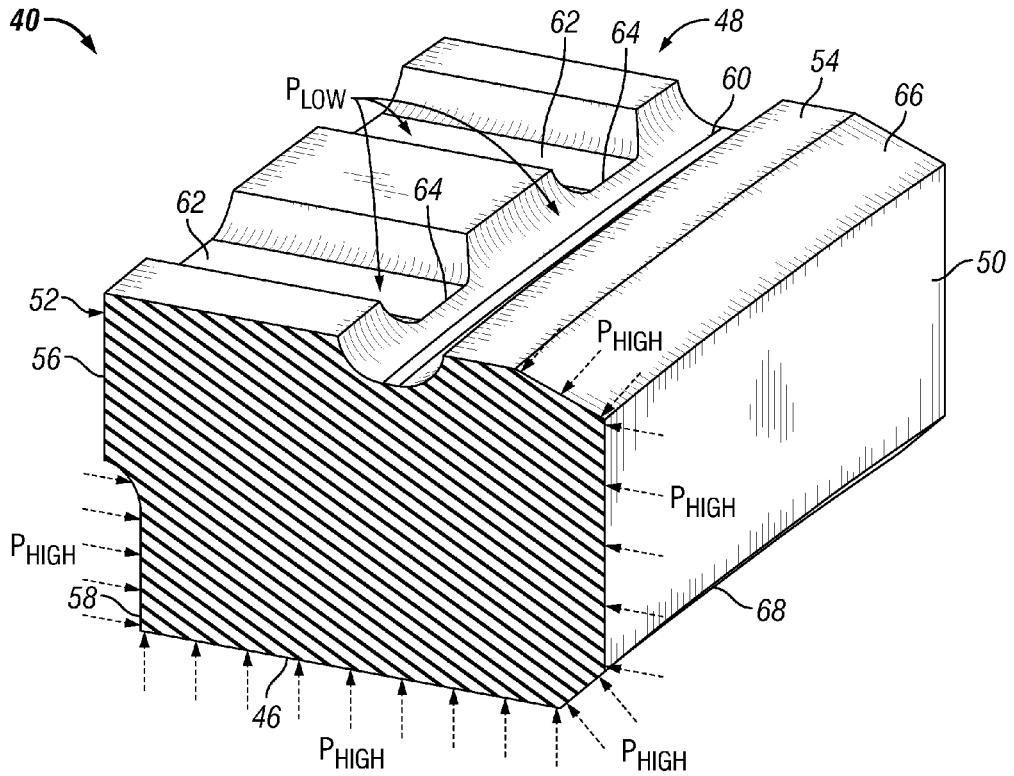
FIG. 2 illustrates a partial cross-sectional, perspective view of a portion of the annular seal of FIGS. 1A and 1B, according to one or more embodiments of the present disclosure.

FIG. 2 illustrates a partial cross-sectional, perspective view of a portion of the annular seal 40 shown in FIGS. 1A and 1B, according to one or more embodiments of the present disclosure. As shown in FIG. 2, the annular seal 40 may form a generally rectangular cross-section, including an inner radial surface 46, an outer radial surface 48, a first axial sidewall 50, and a second axial sidewall 52. The outer radial surface 48 may form an outer sealing surface 54, configured to seat against and form a sealing relationship with the casing groove 36 and the interior surface of the compressor housing 14 when the compressor 10 operates. The second axial sidewall 52 may form a sidewall sealing surface 56, configured to seat against and form a sealing relationship with a wall and/or feature of the compressor bundle casing 26 when the compressor 10 operates.

As shown in FIG. 2, the annular seal 40 may be configured to maintain a high pressure environment (shown in this example as $P_{HIGH}$) about a portion of the annular seal 40 and a low pressure environment (shown in this example as $P_{LOW}$) about a portion of the annular seal 40. The pressure differential across the annular seal 40 may result from different pressures in various chambers and/or passages of the compressor as discussed above. If the annular seal 40 is subjected to a pressure differential, the outer sealing surface 54 and the sidewall sealing surface 56 may form a working seal resisting fluid communication across the annular seal 40. In such an event, a first portion of the annular seal 40 may be subject to and/or maintain the high pressure environment and a second portion of the annular seal 40 may be subject to and/or maintain the low pressure environment.

In the embodiment shown in FIG. 2, the first portion of the annular seal 40 configured to maintain the high pressure environment may include the inner radial surface 46, the first axial sidewall 50, and a recess 58 formed in the second axial sidewall 52. In some embodiments, the recessed portion 58 may define a rabbet. The second portion of the annular seal 40 configured to maintain the low pressure environment may include a portion of the outer radial surface 48 disposed between the sidewall sealing surface 56 and the outer sealing surface 54. The pressure differential between the high pressure environment and the low pressure environment may force the sidewall sealing surface 56 against a surface of the compressor bundle casing 26 and force the outer sealing surface 54 against the compressor housing 14, increasing the effectiveness of the pressure seal provided by the annular seal 40.

The outer radial surface 48 may define at least one annular groove 60 and a plurality of slots 62 spaced circumferentially about the outer radial surface, each slot 62 having an end 64 terminating in the annular groove 60. The annular groove 60 may be formed adjacent the outer sealing surface 54, as shown in FIG. 2. The plurality of slots 62 may provide fluid communication between the inlet gap 44 and the annular groove 60. The arrangement of the annular groove 60 and the plurality of slots 62 may maintain the low pressure across the low pressure environment.

The annular seal 40 may include a first chamfer 66 and a second chamfer 68. The first chamfer 66 may be formed at the junction of the first axial sidewall 50 and the outer radial surface 48. In some embodiments, the first chamfer 66 may be adjacent the outer sealing surface 54. The second chamfer 68 may be formed at the junction of the first axial sidewall 50 and the inner radial surface 46. In embodiments including a first chamfer 66 and/or a second chamfer 68, the chamfers 66, 68 may be subject to the high pressure environment.

The annular seal 40 may be formed from one or more materials suitable for its intended purpose, including polymers and/or metals. In some embodiments, the material of the annular seal 40 may be chosen for low modulus of elasticity, allowing the sealing surfaces 54, 56 to seat and create a seal under a relatively small pressure gradient. The size of the annular seal 40 may depend on several factors, including the geometry of the compressor housing 14 and/or the compressor bundle casing 26, as well as the properties of the material chosen.

Some embodiments of the annular seal 40 may be at least partially formed, for example, from Inconel 625, PEEK (polyetheretherketone), and/or TORLON (manufactured by Amoco Chemicals Corporation); however, such examples are non-limiting and other suitable materials known by those of ordinary skill in the art are contemplated herein. A material with a higher modulus of elasticity may require less material to withstand the physical stresses imposed while a material with a lower modulus of elasticity may require a larger annular seal 40 to withstand the physical stresses.

Figure 3:
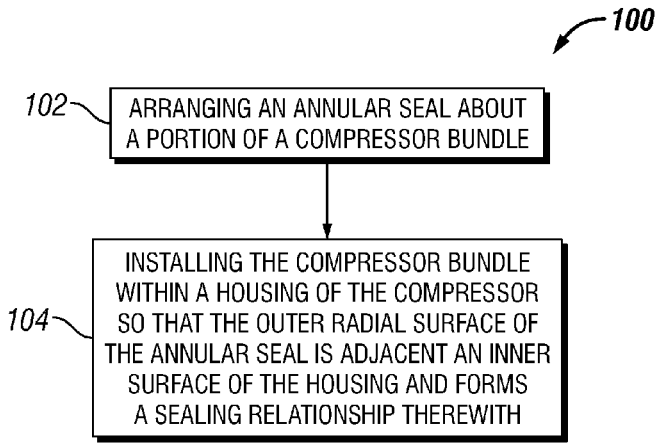
FIG. 3 illustrates a flowchart of an exemplary method for sealing a compressor, according to one or more embodiments of the present disclosure.

FIG. 3 illustrates an exemplary method 100 for sealing a compressor according to one or more embodiments of the present invention. The method 100 may include arranging an annular seal about a portion of a compressor bundle, as at 102. The annular seal may include an inner radial surface defining an inner diameter of the annular seal and an outer radial surface opposing the inner radial surface and defining an outer diameter of the annular seal. The outer radial surface may form an outer sealing surface and the outer radial surface may further define at least one annular groove and a plurality of slots spaced circumferentially about the outer radial surface, each slot having an end terminating in the annular groove.

The annular seal may also include a first axial sidewall forming a sidewall sealing surface and a recessed portion. The annular seal may further include a second axial sidewall opposing the first axial sidewall. The annular seal may form a generally rectangular cross-section, and the annular groove and the plurality of slots may be configured to maintain a low pressure environment across at least a portion of the outer radial surface. The second axial sidewall, the recessed portion, and the inner radial surface may be configured to maintain a high pressure environment there across during operation of the compressor The method 100 may also include installing the compressor bundle within a housing of the compressor so that the outer radial surface of the annular seal is adjacent an inner surface of the housing and may form a sealing relationship therewith, as at 104.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A compressor comprising:

a housing;

a shaft rotatably mounted with respect to the housing;

a compressor bundle arranged around the shaft and disposed at least partially within the housing; and an annular seal mounted about a portion of the compressor bundle, such that the annular seal is disposed between the housing and the compressor bundle, the annular seal comprising:

an inner radial surface defining an inner diameter of the annular seal;

an outer radial surface opposing the inner radial surface and defining an outer diameter of the annular seal, the outer radial surface forming an outer sealing surface and the outer radial surface further defining at least one annular groove and a plurality of slots spaced circumferentially about the outer radial surface, each slot having an end terminating in the at least one annular groove;

a first axial sidewall forming a sidewall sealing surface and a recessed portion; and a second axial sidewall opposing the first axial sidewall, wherein the annular seal forms a generally rectangular cross-section;

wherein the at least one annular groove and the plurality of slots are configured to maintain a low pressure environment across at least a portion of the outer radial surface disposed adjacent an inner surface of the housing; and wherein the second axial sidewall, the recessed portion, and the inner radial surface are configured to maintain a high pressure environment there across during operation of the compressor.

2. The compressor of claim 1, wherein the annular seal is at least partially formed from a polymer.

3. The compressor of claim 1, wherein the annular seal is at least partially formed from a metal.

4. The compressor of claim 1, wherein the annular seal further comprises:

a first chamfer formed at a junction of the first axial sidewall and the outer radial surface; and a second chamfer formed at a junction of the first axial sidewall and the inner radial surface.

5. The compressor of claim 1, wherein the recessed portion comprises a rabbet.

6. A method for sealing a compressor, the method comprising:

arranging an annular seal about a portion of a compressor bundle, the annular seal comprising:

an inner radial surface defining an inner diameter of the annular seal;

an outer radial surface opposing the inner radial surface and defining an outer diameter of the annular seal, the outer radial surface forming an outer sealing surface and the outer radial surface further defining at least one annular groove and a plurality of slots spaced circumferentially about the outer radial surface, each slot having an end terminating in the at least one annular groove;

a first axial sidewall forming a sidewall sealing surface and a recessed portion; and a second axial sidewall opposing the first axial sidewall, wherein the annular seal forms a generally rectangular cross-section;

wherein the at least one annular groove and the plurality of slots are configured to maintain a low pressure environment across at least a portion of the outer radial surface; and wherein the second axial sidewall, the recessed portion, and the inner radial surface are configured to maintain a high pressure environment there across during operation of the compressor; and installing the compressor bundle within a housing of the compressor so that the outer radial surface of the annular seal is adjacent an inner surface of the housing and forms a sealing relationship therewith.

7. The method of claim 6, wherein the annular seal is at least partially formed from a polymer.

8. The method of claim 6, wherein the annular seal is at least partially formed from a metal.

9. The method of claim 6, wherein the annular seal further comprises:

a first chamfer formed at a junction of the first axial sidewall and the outer radial surface; and a second chamfer formed at a junction of the first axial sidewall and the inner radial surface.

* * * * *